US007669372B2

(12) United States Patent
Schaffer

(10) Patent No.: US 7,669,372 B2
(45) Date of Patent: Mar. 2, 2010

(54) STRUCTURAL INSULATED PANEL AND PANEL JOINT

(75) Inventor: Lisa Clear Schaffer, Hamilton, OH (US)

(73) Assignee: T. Clear Corporation, Hamilton, OH (US)

( * ) Notice: Subject to any disclaimer, the term of this patent is extended or adjusted under 35 U.S.C. 154(b) by 1040 days.

(21) Appl. No.: 11/052,465

(22) Filed: Feb. 7, 2005

(65) Prior Publication Data

US 2006/0185305 A1 Aug. 24, 2006

(51) Int. Cl.
*E04C 1/40* (2006.01)

(52) U.S. Cl. ..... 52/309.7; 52/481.1; 52/586.2; 52/797.1; 52/309.12

(58) Field of Classification Search ..... 52/309.2, 52/309.7, 309.9, 309.11, 309.16, 582.1, 586.2, 52/586.1, 800.1, 796.12, 797.1, 802.1, 241, 52/481.1, 481.2, 794.1, 790.1, 309.12
See application file for complete search history.

(56) References Cited

U.S. PATENT DOCUMENTS 3,196,499 A * 7/1965 Houvener ..... 52/794.1
4,099,355 A * 7/1978 Strunk ..... 52/404.3
4,312,158 A * 1/1982 Teli et al. ..... 52/39
4,633,634 A * 1/1987 Nemmer et al. ..... 52/474
4,712,352 A * 12/1987 Low ..... 52/794.1
5,129,628 A * 7/1992 Vesper ..... 256/31
5,136,822 A * 8/1992 Blum ..... 52/241
5,245,809 A * 9/1993 Harrington ..... 52/309.11
5,524,400 A * 6/1996 Schmechel ..... 52/474
5,966,885 A * 10/1999 Chatelain ..... 52/309.4
6,065,259 A * 5/2000 Clear ..... 52/284
6,701,684 B2 * 3/2004 Stadter ..... 52/309.7
2003/0079428 A1 * 5/2003 Rivers ..... 52/270
2003/0196404 A1 * 10/2003 Dennis ..... 52/582.1
2004/0255525 A1 * 12/2004 Bishop ..... 52/79.1

* cited by examiner

*Primary Examiner*—Robert J Canfield
*Assistant Examiner*—Christine T Cajilig
(74) *Attorney, Agent, or Firm*—Wood, Herron & Evans, LLP

(57) ABSTRACT

An improved structural insulated panel and panel joint includes a panel having a core with cementitious facings where the core edge is grooved and along the panel side edges rebated to accommodate a connecting column. A connecting column is "H"-shaped, formed from two "C"-shaped channels sealed together along other webs with legs directed outwardly and for use between two of the panels. Multiple wall structures and details are disclosed.

3 Claims, 5 Drawing Sheets

STRUCTURAL INSULATED PANEL AND PANEL JOINT

BACKGROUND OF THE INVENTION

This invention relates to structural insulated wall panels and more particularly to improved joint structures in such panels.

Structural insulated wall panels to which this invention relates are generally known. For example, such panels are disclosed in U.S. Pat. Nos. 5,992,110 and 6,065,259, which are herewith expressly incorporated herein by reference. Such panels include a composite of a foam or insulative core faced preferably on both sides with a reinforced cementitious facing as disclosed in said patents and which is sold under the trademark "Util-A-Crete". Such facing panels are described, for example, in U.S. Pat. Nos. 4,203,788; 4,428,952; 4,420,295; RE 32,037; RE 32038; and RE 31,921, each of which is herewith expressly incorporated herein by reference.

In U.S. Pat. Nos. 5,992,110 and 6,065,259, the structural insulated panels described therein are provided with grooves formed in the foam core and extending from the panel edges into the foam or insulating core. At the abutting edges, connecting tongues are inserted into aligned grooves of adjacent panels and fasteners are applied through the panel facings into the tongues to interconnect adjacent panels.

While such panels offer numerous advantages, it is now desirable to provide improvements to the joint structures and joining methods for assembling structural insulated panels into multiple panel walls.

A further objective of the invention has been to improve the structural integrity of a panel wall at the panel joints.

A further objective has been to enhance thermal and resistance with improved panel joint structures.

A still further object of the invention has been to enhance wind pressure resistance of a multiple panel wall.

A still further objective of the invention has been to enhanced retained structural integrity in the circumstance of panel destruction by fire or other causes.

SUMMARY OF THE INVENTION

To these ends, an improved panel and joint structure is provided which produces a more rigid and stronger panel join, while maintaining enhanced thermal and moisture-resistance at the panel joint. Both improved panel structure and improved joint connectors are provided.

According to one preferred embodiment of the invention, an improved joint connector, sometimes referred to herein as a connecting column, includes two "C"-shaped channels, joined web-to-web to form an "H"-shaped column. This is used in place of the former connector "tongues" of U.S. Pat. Nos. 5,992,110 and 6,065,259. Such improved connector column is formed by first applying at least one and preferably two beads of any suitable seal material, such as urethane, at a location between the webs of respective "C"-shaped channels, then pressing the web together where spot welds are applied to secure them so an "H"-shaped beam or connector column is formed. The urethane seal prevents transmission of moisture, vapor and air between the webs and through the column.

The web of the "C"-shaped channels are of sufficient width to span the edge face of the foam or synthetic panel core between the grooves therein. When used to connect two panels together, the webs of the connecting column extend between the grooves at the panel joint while the opposed flanges of the two "C"-shaped channels extend into opposite aligned grooves where fasteners can be applied therein through the panel faces, as with the old tongues.

The formed, "H"-shaped connector column provides greater strength and rigidity at the panel joint, where the flanges bridge the panel joint and are secured and where the webs join the flanges to improved structural rigidity. Moreover, if the panels were burned so as to consume the foam core, the solid connecting column of "H"-shaped configuration remains to provide residual structural support.

An improvement is also made to the panels themselves, facilitating use of the improved connector column. Particularly, the edge faces of the panels between the grooves are rebated so they do not lie in the same plane as the edges of the panel facings and the foam core outside the grooves. Instead, the interior foam edge faces are retracted or rebated to at least accommodate the webs of the "H"-shaped connecting column. These interior web faces thus never abut the corresponding faces of the adjacent panels. Instead, they are rebated to create a recess accommodating the joining webs of the "H"-shaped connector column. Assembly of the adjacent panels is thus facilitated, with edge-to-edge abutment of the respective edges of the adjoining panel facings.

Similar rebating of the interior core edges at panel top and bottom accommodates the respective floor and cap "C"-shaped channels extending along bottom and top edges of the adjoining panels for structural rigidity.

As a result, the assembled multiple panel wall demonstrates substantial structural integrity, thermal, moisture, vapor and air pass-through resistance at panel joints, and substantial wind pressure and racking force resistance. All other advantages of prior structural insulating panels as disclosed in U.S. Pat. Nos. 5,992,110 and 6,065,259 are retained.

In addition, multiple panel walls, with the foregoing improvements, can be used as foundation walls, for example. In such cases, a multiple panel wall is set, and a second multiple panel wall is sealed or glued to it with joints of each wall being offset. In such a foundation wall application, a foundation wall of double panel thickness is formed.

These and other advantages and applications will become readily apparent from the following detailed description and from the drawings in which:

Figure 5:
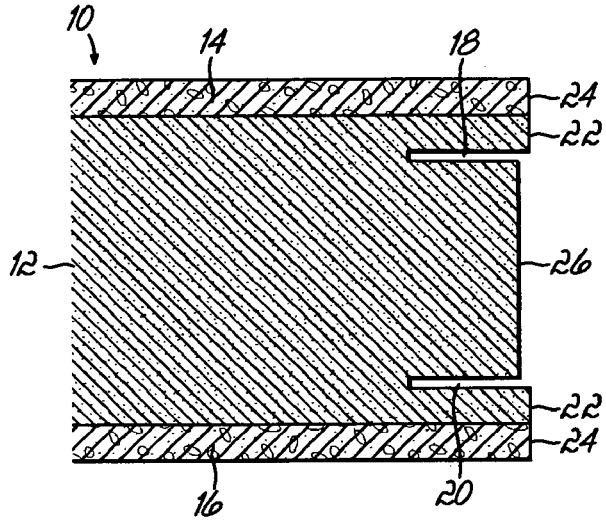
FIG. 5 is a cross-sectional view of an edge of a panel of FIG. 1.
Figure 6:
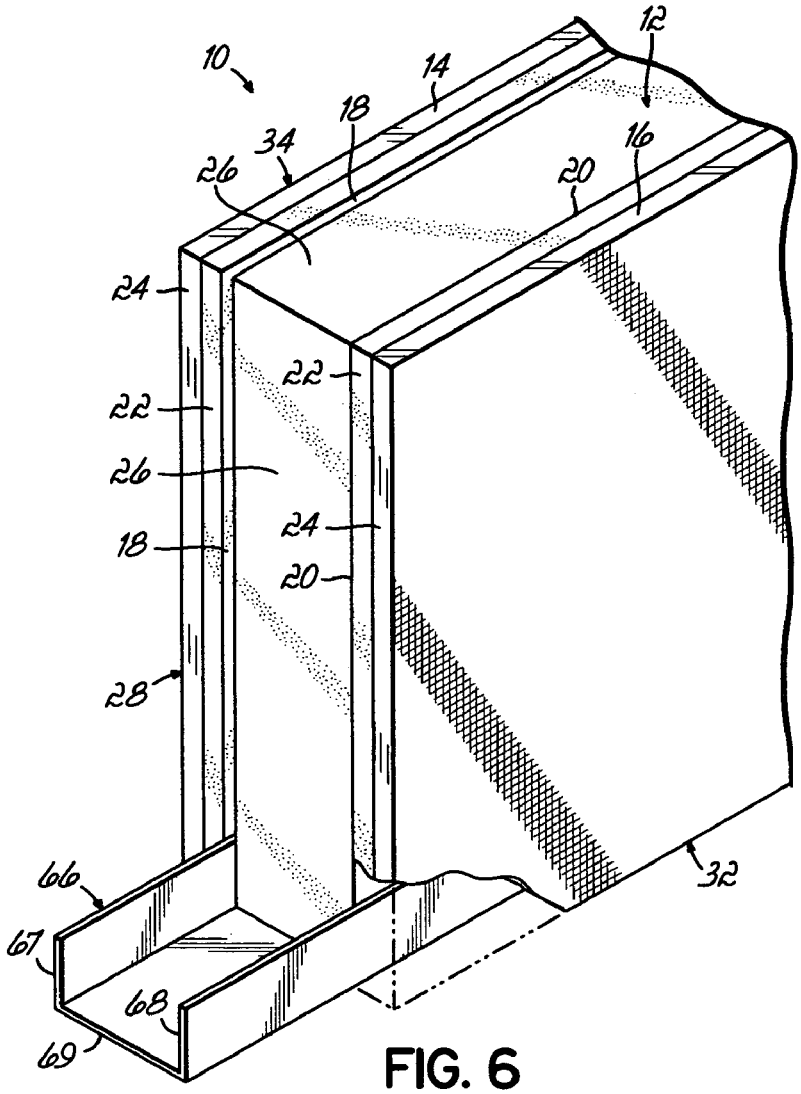
FIG. 6 is an isometric view of the bottom structure of a panel of FIG. 1.

Details of a structural insulated panel 10, according to the invention, are perhaps best seen in FIGS. 5 and 6 where the panel 10 is a composite of a core 12, and facings 14, 16 on opposite major side faces of panel 10. Core 12 is an insulative core of preferably synthetic materials such as a synthetic foam of any appropriate composition. One such foam is extruded polystyrene foam plastic STYROFOAM 40, manufactured by The Dow Chemical Company of Midland Mich. The foam plastic core has a nominal density of 2.0 pcf (32.0 kg/m$^3$), and is manufactured in a 3¾-inch (95 mm) thickness and planed to about 3⅝-inch (92 mm) thickness for use in panel fabrication.

Facings 14, 16 are preferably about ¼-inch-thick (6.4 mm) concrete, glass-fiber-mesh-reinforced panels manufactured by Fin Pan, Inc. of Hamilton, Ohio under its mark Util-A-Crete.

The facings are bonded to the extruded polystyrene core using any suitable sandwich panel adhesive, such as a Type II, Class 2, cementitious product composed of Type I portland cement, Type F fly ash, and a latex/water emulsion.

Such panel construction produces a structural insulated panel about three feet wide, and of various lengths such as eight feet, nine feet, ten feet and twelve feet or other desirable lengths and various thicknesses such as 4½ inches thick, or any other desirable thickness. The panel can be made of any desired dimensions and component thicknesses and any suitable panels having a core and facings could be used.

The edge configuration of the panels 10 is significant. At each side, top and bottom edge of panel 10, the core edges are exposed. Grooves 18, 20 are cut into the core edges. Each groove is at least about two inches (51 mm) deep and about ⅛ inch (3.2 mm) in width.

As noted, the core 12 has an edge 22 which is in the same plane as edges 24 of the facings 14, 16 and runs along the panel edges with edges 24. In particular, the core also has an exposed but rebated or relieved edge 26 between grooves 18, 20. This rebated edge runs around the panel 10 with edges 22 and 24, but is spaced or oriented internally of edges 22, 24 within panel 10. In other words, core edge 26 is located in a plane in panel 10 internally of the plane defined by edges 22, 24. This relationship is best seen in FIG. 5 where edge 26 is rebated from edges 22, 24 for example. The depth of rebated edge 26 from the edges 22, 24 representing the panel edge is about or similar to the thickness of an 18 to 20 gauge galvanized or steel plate, as will be described.

Accordingly, each panel has two side edges 28, 30, one bottom edge 32 and one top edge 34. For illustrative and descriptive purposes, these edges 28, 30, 32 and 24 are defined by the previously described facing edges 24 and core edges 22. The exposed and rebated core edge 26 is disposed slightly internally of panel edges 28, 30, 32 ad 24.

Figure 3:
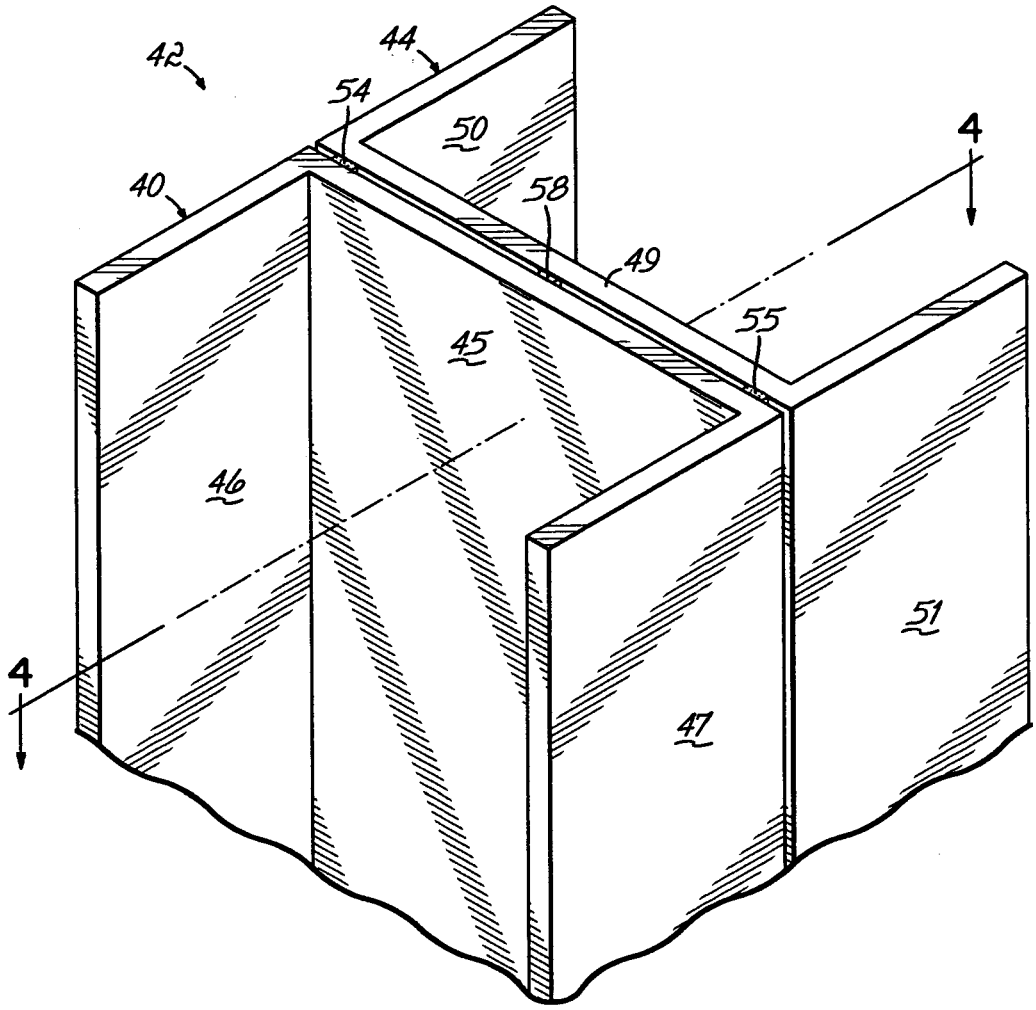
FIG. 3 is an isometric view of a connector column according to the invention.
Figure 4:
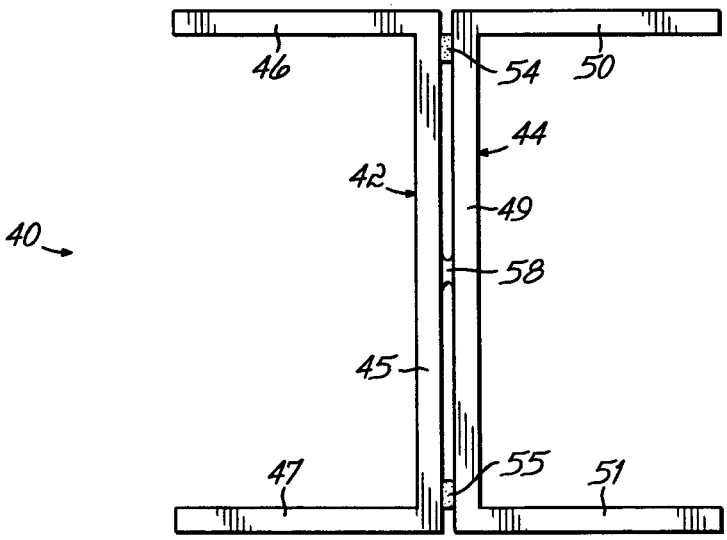
FIG. 4 is a cross-sectional view taken along lines 4-4 of FIG. 3.

Details of a preferred "H"-shaped connecting column 40 are best seen in FIGS. 3 and 4. Column 40 is a composite of two "C"-shaped channels 42, 44. Channel 42 has a web 45 and legs 46, 47. Channel 44 has a web 49 and legs 50, 51.

Channels 42, 44 are sealed together in back-to-back fashion to form the "H"-shaped column 40. Preferably, two elongated beads 54, 55 of a suitable sealant such as urethane based sealant material are deposited so as to lie between webs 45, 49 as shown. The channels 42, 44 are then pressed together, compressing sealant beads 54, 55 between webs 45, 49. Spot welds 58 are applied, securing webs 45, 49 and thus channels 42, 44 together. Once cured, the sealant beads 54, 55 resist moisture and vapor transmission between webs 45, 49 along their length and that of column 40.

Figure 2:
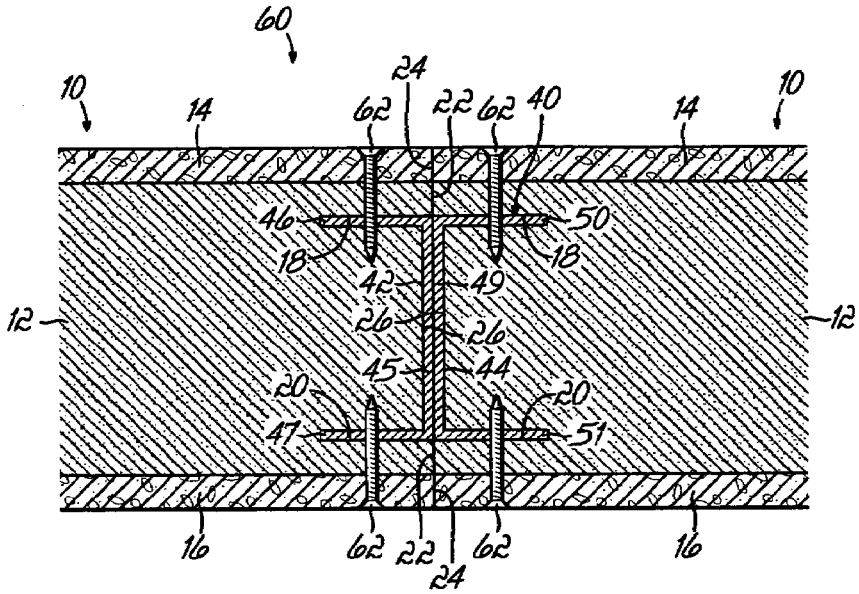
FIG. 2 is a cross-sectional view of a panel joint taken along lines 2-2 of FIG. 1.

Column 40 is preferably of a length about four inches or more short of the height of panels 10, such as nominally illustrated in FIG. 2.

Channels 42, 44 are made of any suitable material, such as 20 gauge galvanized metal or steel. Where higher wind or other structural loads are anticipated, thicker gauges, such as 18 gauge, can be used. The legs of channels 42, 44 are of any suitable length, generally shorter, however, than the depth of grooves 18, 20.

Figure 1:
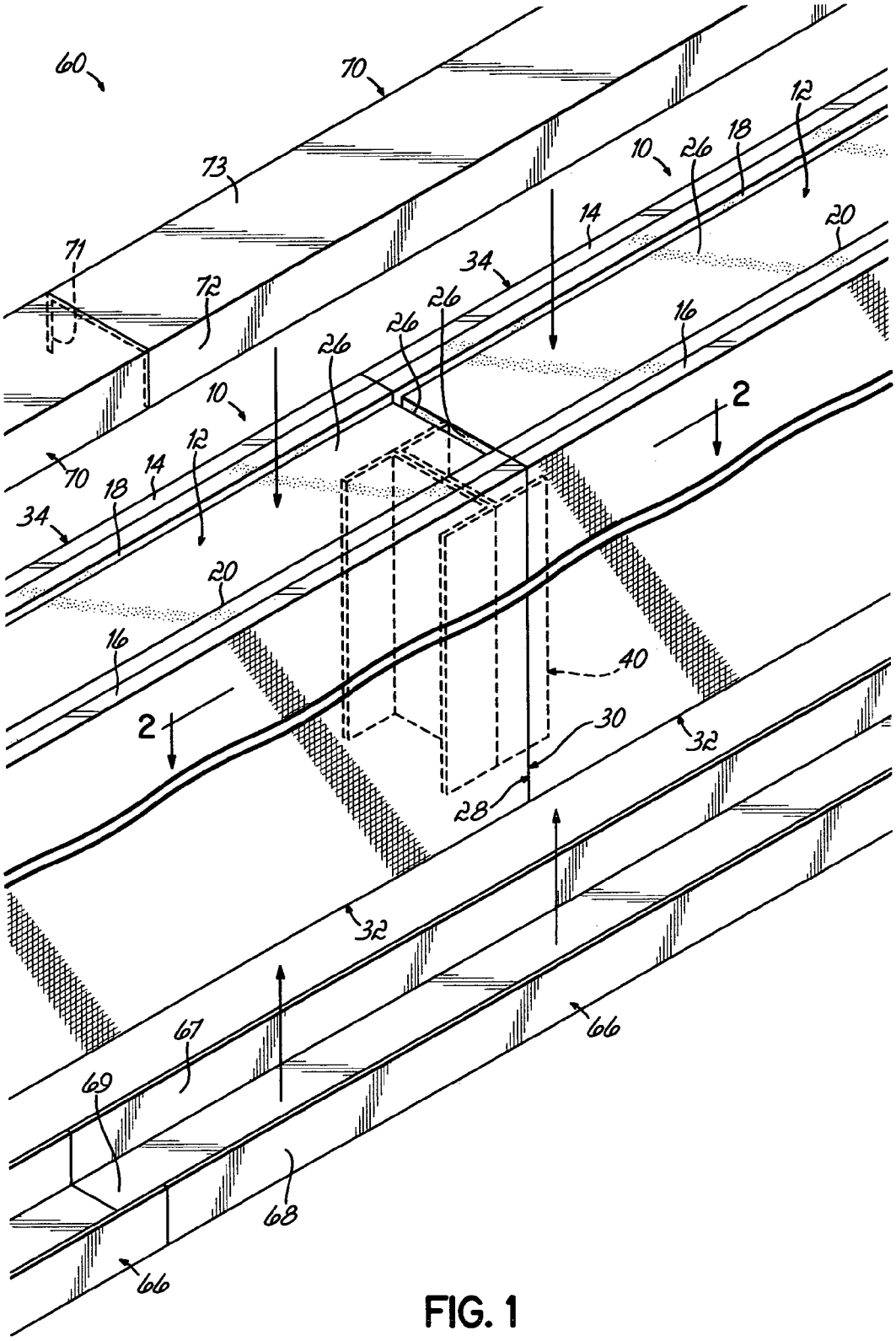
FIG. 1 is an expanded isometric view of a preferred embodiment of the invention and shows the joint between two panels.
Figure 2A:
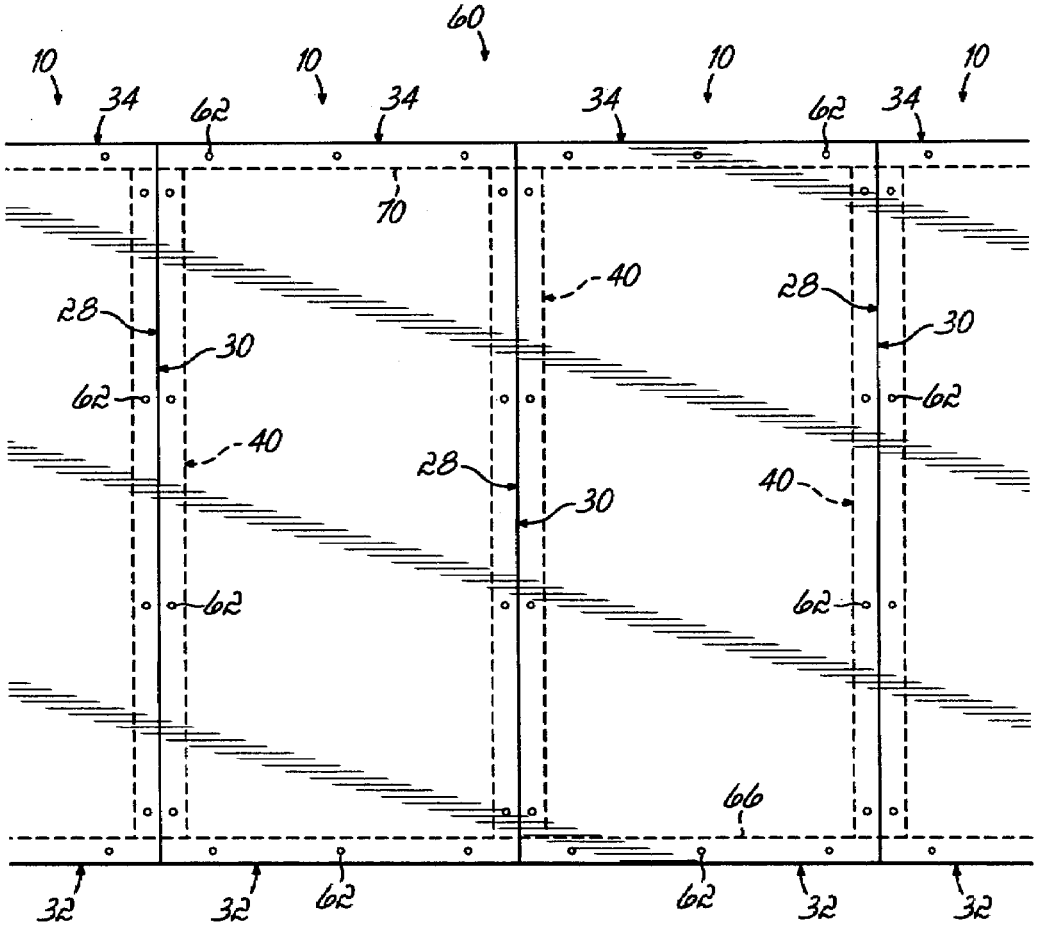
FIG. 2A is an elevational view of a multiple panel wall of FIG. 1.

A multiple panel wall 60 is illustrated in FIGS. 1, 2 and 2A. Turning first to the joining of panels 10 in wall 60, see FIG. 2 where two panels 10 are brought into adjacent edge-to-edge relation with connecting column 40 (hidden) therebetween. In this structure, legs 46, 47 of "H"-shaped column 40 extend respectively into grooves 20, 18. Legs 50, 51 of column 40 also extend into respective grooves 20, 18 of an adjacent panel 10. After the two panels 10 are so oriented, any suitable fasteners 62 are applied at desired intervals through facings 14, 16 through the core between the facings 14, 16 and the grooves 18, 20 and into the legs 46, 47, 50 and 51. Two adjacent panels 10 are thus rigidly and securely interconnected panel edge-to-edge, to form a multiple panel wall 60. Other panels are similarly joined to a desired wall length.

Several observations can be made about the joint between the side edges 28, 30 of the panels 10 and as seen in FIGS. 1, 2 and 2A. It will be noted that panel edges 28, 30 defined by facing edges 24, and core edges 22, are preferably abutting so there is only a small exterior seam along the panel edges. Such a seam is easily covered by traditional finishing techniques.

The rebated core edges 26 of each adjacent panel do not, however, abut. Instead, the rebated edges accommodate the thickness of the sealed together webs 45, 49 of the "H"-shaped connecting column 40. This allows abutment of side panel edges 28, 30 while accommodating column 40 within and across or bridging the panel edges. So while the major panel edges 28, 30 abut, the major core edges 26 do not, but are rebated, reduced or relieved to accommodate column 40.

Connection of the panels 10 to a support base such as a floor, along panel bottom edge 32 is illustrated in FIGS. 1, 2A and 6. An elongated "C"-shaped channel 66 is secured to a base through web 69 so its legs 67, 68 extend upwardly. Panels 10 are set onto channel 66 so legs 67, 68 extend into grooves 18, 20 respectively along bottom edges 32 of the panels 10. Preferably, the channels 66 are arranged so the joints at their ends are not aligned with any joint between adjacent panels 10.

The connecting structure at the top of panels 10 in a multiple panel wall 60 is best seen in FIGS. 1 and 2A. Once adjacent panels 10 are set in place with column 40, an elongated "C"-shaped channel 70 is applied across the panel top edges 34. Channel 70 has depending legs 71, 72 disposed in grooves 20, 18 respectively defined in panel top edges 34.

The cooperation of legs 71, 72 of upper or cap channel 70 and legs 67, 68 of lower or floor plate channel 66 with the column 40 will now be explained. Webs 69, 73 of channels 66, 70 respectively, are wider than the webs 45, 49 of the column 40. Accordingly, the lower ends of legs 46, 47 and 50, 51 of column 40 reside within the upstanding legs 67, 68 respectively, of channel 66 when the column 40 is in a plane, and in overlapping orientation. Likewise, the upper ends of legs 46, 47 and 50, 51 of column 40 reside within the depending legs 71, 72 respectively, of the upper channel 70 and in overlapping fashion.

Appropriate fasteners 62 of any suitable type are applied through the facings 14, 16, on each side of the panels, the foam of the core, between the facings and grooves and the adjacent legs of the column 40 and channels 66, 70 as shown in FIG. 2A to secure the channels 66, 70, column 40 and panels of a multiple panel wall 60 together. The grooves are wide enough to accommodate the adjacent overlapping portion of the column 40 and channels 66, 70.

As with column 40 any suitable fasteners 62 are applied at intervals through facings 14, 16, the core material between facings 14, 16, and grooves 18, 20 and into the respective legs of channels 66 and 70 to further secure the panels 10.

As with channel 66, the top channel 70 is preferably applied so it bridges the joint between two panels 10 and so its ends are not aligned with the panel joint.

The legs of channels 66 and 70 are of any suitable length, preferably shorter, however, than the depth of grooves 18, 20.

Panels 10 may thus be used as structural insulated panels to form structural insulated multiple panel walls 60 on any suitable base. The panels may be used for external or internal structure insulated walls with any appropriate exterior or interior finish techniques being applied as desired. The panel walls 60 may form one story structures on any suitable base or floor, with roofing components applied to the top edges of the panels, or in multiple story applications.

The new "H"-shaped column 40 with rebated core edges 26 accommodate and provide enhanced structural rigidity and resist thermal, moisture and vapor transmission. A high insulative value, together with enhanced structural rigidity and resistance to wind loads, racking and other stresses are provided while ease of erection is maintained.

In another application, a multiple panel foundation wall can be formed from panels 10. Such an application is illustrated in FIG. 7 where multiple panel walls 76, 78 are joined to form a foundation wall 80.

For example, a first wall 76 (like wall 60) is formed of multiple panels 10 (only one being shown) as in FIGS. 1, 2 and 2A. A second wall 78 (like wall 60) is formed of multiple panels 10, also joined as in FIGS. 1, 2 and 2A.

Figure 7:
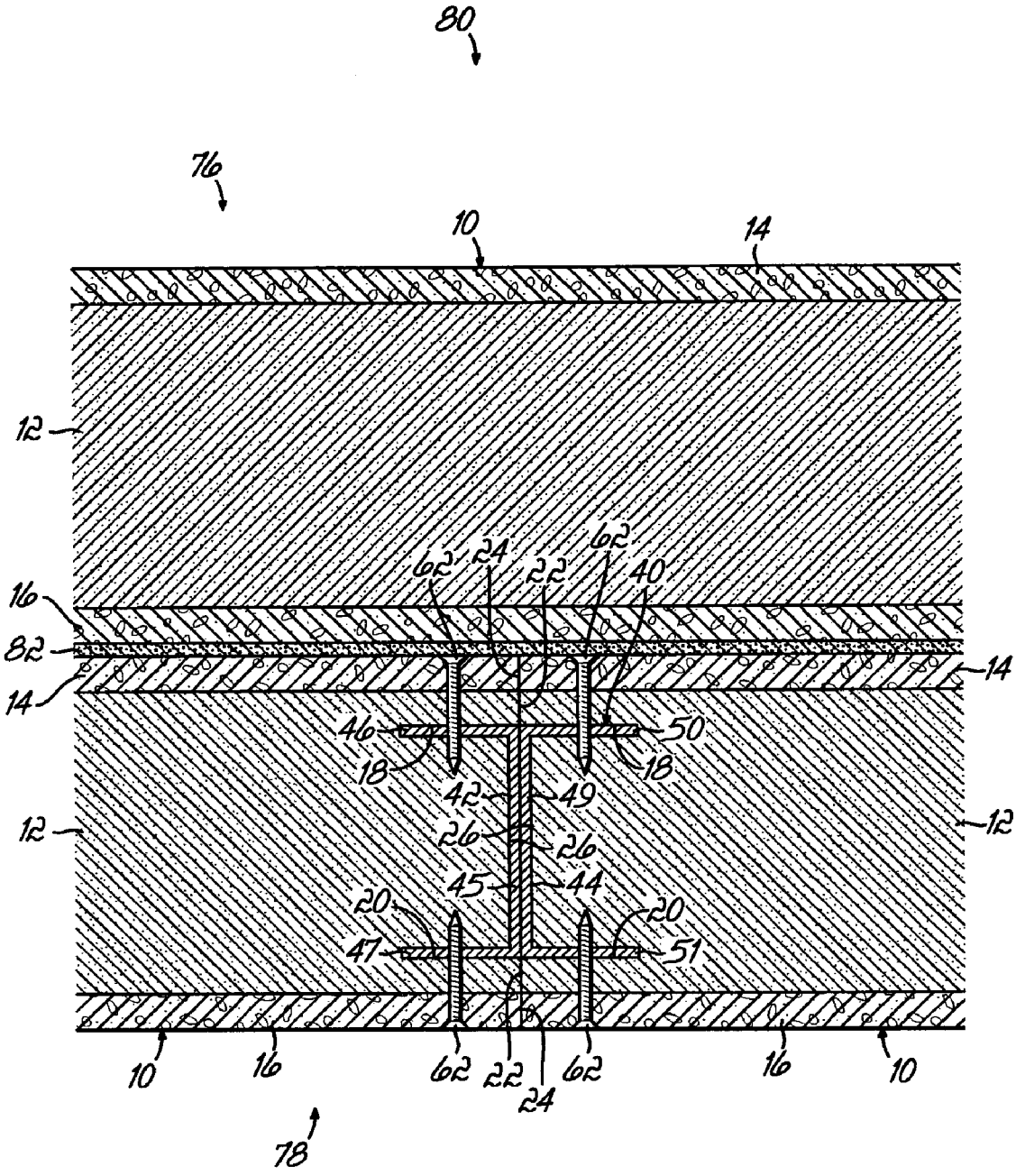
FIG. 7 is a cross-sectional view of a multiple panel foundation wall according to the invention.

The walls 76, 78 are formed so the joints between individual panels 10 of one wall are not aligned with, but are staggered from, the panel joints of the other wall, as illustrated in FIG. 7.

Wall 76 is sealed to wall 78 by an appropriate sealant 82 to form foundation wall 80.

Accordingly, a foundation wall 80 is formed and is about twice as thick as a single multiple panel wall.

It will be appreciated that the components of the panels 10 and walls 60, 76 and 78 can be varied in size and in materials, which still retaining the advantages as expressed above. Panels can be shaped and cut to provide for door and window or other portal openings and headers. Electric chases and switch and outlet openings can be performed in the panels. Joist brackets and numerous other connecting or coupling devices can be used to combine other structures with the panels. Corner structures can be provided with angle cut panel edges and angular joining splines or corner columns. "C"-shaped channels can be used at panel edges open for accommodation of window, door or other opening frames.

These and other modifications, advantages and embodiments will be readily apparent to one of ordinary skill in the art without departing from the scope of the invention and applicant intends to be bound only by the claims appended hereto.

What is claimed is:

1. A structural insulated wall of the type comprising a plurality of adjoined structural insulated panels wherein said panels comprise a structural insulated panel of the type having an insulating core, a reinforced cementitious facing on opposed surfaces of the core, the panel having side, top and bottom edges and the core being exposed at edges of the panel, and grooves cut within the core within the side panel edges for receiving a connecting column for connecting two panels together, said wall further comprising:

an "H"-shaped connecting column disposed between side edge portions of adjoining panels;

said column comprising a pair of back-to-back "C"-shaped channels having oppositely extending legs, the channels sealed together with legs of said channels being oriented in said grooves disposed in exposed side edges of said cores of respective panels;

said side edges of said cores between said grooves being disposed inwardly of adjacent side edges of said panel facings along the entire panel side edges to accommodate said connecting column when respective edges of said facings of adjoining panels are positioned adjacent one another; and wherein said connecting column is shorter than the length of adjacent panel edges between which it is oriented.

2. In a wall structure comprising at least two adjacent structural wall panels, the combination therewith of an "H"-shaped connecting column for securing together said two adjacent structural insulated wall panels each having an insulated core and an outer facing on each side thereof, with grooves extending into respective adjacent side edges of each adjacent panel within said core, said "H"-shaped column comprising:

two "C"-shaped channels, each having a connecting web and two legs extending at right angles from said web, said channels being sealed together along respective connecting webs thereof with said respective two legs of each channel extending outwardly from said webs and disposed within respective grooves within said adjacent panel edges; and wherein said connecting column is shorter than the length of adjacent panel edges between which it is oriented.

3. A structural insulated foundation wall comprising:

a first wall formed of adjacent structural insulated wall panels having adjacent edges and an "H"-shaped connector column therebetween;

a second structural insulated wall panel comprising an insulated panel parallel to said first wall;

said insulated wall panels comprising a core having opposed side surfaces and a reinforced cementitious facing disposed on each side surface of said core;

said "H"-shaped connector column between said panels in said first wall being disposed opposite said panel of said second wall, wherein said "H"-shaped connector columns comprise two "C"-shaped channels having webs connected to each other and outwardly extending legs extending from said webs, said panels comprising an insulating core having grooves disposed in edges of said core and within said core, said legs of said "C"-shaped channels extending into respective ones of said grooves within said core, and a side edge of said core between said grooves in each panel being rebated between said grooves throughout said side edges of each panel; and wherein said connector column is shorter than the length of adjacent panel edges between which it is oriented.

* * * * *